US006711856B1

(12) United States Patent
Hoffman

(10) Patent No.: US 6,711,856 B1
(45) Date of Patent: Mar. 30, 2004

(54) DOOR OPENER ASSIST DEVICE

(76) Inventor: Drew Hoffman, 877 SW. Summit View Dr., Portland, OR (US) 97204-3795

( * ) Notice: Subject to any disclaimer, the term of this patent is extended or adjusted under 35 U.S.C. 154(b) by 0 days.

(21) Appl. No.: 10/251,553

(22) Filed: Sep. 19, 2002

(51) Int. Cl.[7] ..... E05F 1/10
(52) U.S. Cl. ..... 049/386; 296/207
(58) Field of Search ..... 49/386, 324, 354, 49/276, 72; 296/207; 292/DIG. 72

(56) References Cited

U.S. PATENT DOCUMENTS 5,369,911 A 12/1994 Fortunato
6,338,536 B1 * 1/2002 Ueno et al. ..... 312/405
6,553,617 B1 * 4/2003 Salice ..... 16/85

OTHER PUBLICATIONS

GNU Catalog, Door Popper DP3, website page www.commandoalarms.com/itm00033.htm, Aug. 28, 2002, pp 1.

* cited by examiner

*Primary Examiner*—Jerry Redman
(74) *Attorney, Agent, or Firm*—Ganz Law, PC; Paul J. Fordenbacher, Esq.

(57) ABSTRACT

The present invention provides a door opening assist device comprising a spring-biased piston having a threaded bore mounted in a cylindrical housing by a threaded bolt. The piston retains a spring within the housing at a first end of the housing. The threaded bolt engages the piston from a second end of the housing. The piston is retained within the housing by the cooperative engagement between the spring urging the piston out of the first end and the head of the bolt in abutment with the second end. The door opening assist device is installed in a door frame of an automobile to push the door open a predetermined distance. The door opening assist device provides various mounting options. Upon closing the door, the door abuts and retracts the piston into the housing compressing the spring. Upon unlatching the door, the piston extends under spring bias in such a direction and with sufficient force to push the door to an open position a predetermined distance. The cooperative engagement between the bolt and the piston provides adjustment feature to tailor the opening characteristics of the door opening assist device to control the opening of the door.

19 Claims, 4 Drawing Sheets

DOOR OPENER ASSIST DEVICE

FIELD OF THE INVENTION

This invention relates to automobile doors, and more particularly, to door opening assist devices for use on automobile doors, hoods and trunks.

BACKGROUND OF INVENTION

The aggressively competitive automobile industry continuously strives to provide new and exciting features to the new model automobiles. A focus toward style, creature comforts and safety has been a major factor in differentiating one competitor's products from others and premium models from budget models.

With many automobile owners not satisfied with the style, quality, and availability of the features provided by the automakers, owners have turned to aftermarket component manufacturers and even automobile kit manufacturers for satisfaction. The owners of hot rod, street rod, and classic automobiles are always looking for ways to customize and differentiate their cars from others, and styling, shape and form are high on the list of attributes that these owners wish to improve.

A growing trend for customizers is to present their automobiles with a sleek, sculpted body. Body trim components and other embellishments are giving way to smooth body panels, hoods and grills. One component of the automobile that intrudes on the sleek look of the side body panels is the door handle.

The aftermarket component manufacturers are providing the automobile owner with an ever-increasing selection of components to add to, replace, or modify the standard automobile features. A popular aftermarket component is what is known as a shaved door handle system. The shaved door handle system allows for the complete removal of exterior door handles providing a continuous smooth appearance across the side body panels. Without an exterior door handle, the shaved door handle system provides a remotely controlled, electrically powered door lock and latch actuator. Once the door is unlocked and unlatched, there is still a need to open the door as there is no handle to pull the door open. An internal door opening assist device is needed to push open the door to allow entry.

Door opening assist devices come in a variety of forms. Electrically operated solenoids and linear actuators have been used with some success. These systems, though, require electrical power to operate and rather complex timing logic to control activation with respect to the unlock and unlatch mechanisms.

Another type of door opening assist device that has been used is a spring-biased piston, such as the one in U.S. Pat. No. 5,369,911, Fortunato. This device is a spring-biased piston that is mounted in the door frame. When the door is closed, the piston is pushed against a spring by a door surface which compresses the spring. The door latch holds the door in a closed position against the potential energy of the spring-loaded piston. Upon the unlatching of the door, the spring-biased piston extends, pushing against the door surface opening the door. This solution provides a door opening device that requires no power to operate, and requires no timing logic to activate. The shortcomings of the '911 device includes, but is not limited to, that the spring is exposed, which can be a safety hazard as well as a reliability hazard due to dirt and debris infiltration.

Additionally, the current spring-biased piston devices do not have provisions to adjust the tension and throw of the piston. It is desirable for the user to be able to adjust the throw of the door to account for the weight and balance of the door as well as personal preference.

Accordingly, there is a need for a door opener assist device that is simple in operation, requires no electrical power, is easily installed by the consumer, and easily adjustable both in tension and door opening characteristics.

SUMMARY OF INVENTION

The present invention provides a door opening assist device that provides benefits currently lacking in the art. For example, but not limited to, the device has an adjustment feature that controls the extent to which it opens the door. The device has various mounting features adaptable to particular mounting applications. And the device contains the compression spring in the housing, protecting the spring from dirt and the like, while protecting the user from physical injury.

In accordance with an embodiment of the present invention, the door opening assist device comprises a spring-biased piston having a threaded bore mounted in a cylindrical housing by a threaded bolt. The piston retains a spring within the housing at a first end of the housing. The threaded bolt engages the piston from a second end of the housing. The piston is retained within the housing by the cooperative engagement between the spring urging the piston out of the first end and the head of the bolt in abutment with the second end.

In another embodiment in accordance with the invention, the door opening assist device further comprises a flange extending from the first end of the housing. The flange comprises apertures adapted to accept appropriate fasteners to couple the housing to a structure, such as, but not limited to, a doorjamb.

In another embodiment in accordance with the invention, the door opening assist device further comprises a circular flange extending from the first end of the housing and a mounting nut. The first end further comprises threads extending at least a portion of the length of the housing proximate the flange and adapted for threaded engagement with the mounting nut. In application, the second end of the door opening assist device is passed through an aperture in the structure and the mounting nut is advanced onto the threads to engage the structure between the flange and the nut.

In another embodiment in accordance with the invention, the door opening assist device further comprises a circular flange extending from the first end of the housing and a mounting plate comprising an aperture. The first end further comprises a capture ring adapted to slidably engage the aperture of the mounting plate to couple the mounting plate to the housing. The capture ring comprises an enlargement of the diameter of the housing spaced a predetermined distance from the flange corresponding to the thickness of the mounting plate defining a seat. The capture ring provides a rearward facing sloping surface having a diameter proximate the flange that is greater than the diameter of the aperture of the mounting plate to a diameter smaller than the aperture of the mounting plate distal from the flange. In application, the aperture of the mounting plate is passed over the second end of the door opening assist device. The mounting plate is forcefully advanced over the capture ring to snap into the seat between the capture ring and the flange. The mounting plate further comprises apertures adapted to accept appropriate fasteners to couple the housing to a structure, such as, but not limited to, a doorjamb.

In another embodiment in accordance with the invention, the door opening assist device further comprises a circular flange extending from the first end of the housing, a mounting plate having an aperture, and a mounting nut. The first end further comprises threads extending at least a portion of the length of the housing proximate the flange and adapted for threaded engagement with the mounting nut. In application, the aperture of the mounting plate is passed over the second end of the door opening assist device and advanced over the threads to the flange and the mounting nut is advanced onto the threads to engage the mounting plate between the flange and the nut. The mounting plate further comprises apertures adapted to accept appropriate fasteners to couple the housing to a structure, such as, but not limited to, a doorjamb.

In another embodiment in accordance with the invention, the door opening assist device further comprises a circular flange extending from the first end of the housing, a mounting plate having an aperture, and a mounting nut. The first end further comprises a capture ring adapted to slidably engage the aperture of the mounting plate to couple the mounting plate to the housing. The capture ring comprises an enlargement of the diameter of the housing spaced a predetermined distance from the flange corresponding to the thickness of the mounting plate defining a seat. The capture ring provides a rearward facing sloping surface having a diameter proximate the flange that is greater than the diameter of the aperture of the mounting plate to a diameter smaller than the aperture of the mounting plate distal from the flange. The first end further comprises threads extending at least a portion of the length of the housing proximate the capture ring and adapted for threaded engagement with the mounting nut.

In application, the user has the option of discarding the mounting plate and mounting the door opening assist device by passing the second end of the housing through an aperture in the structure and advancing the mounting nut onto the threads to engage a structure between the flange and the nut.

The user also has the option of discarding the mounting nut and, from the second end of the housing, forcefully advancing the aperture of the mounting plate over the capture ring to snap the mounting plate into the seat between the capture ring and the flange. The mounting plate further comprises apertures adapted to accept appropriate fasteners to couple the housing to a structure, such as, but not limited to, a doorjamb.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentality's, procedures, and combinations particularly pointed out in the appended claims.

DESCRIPTION

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Figure 1:
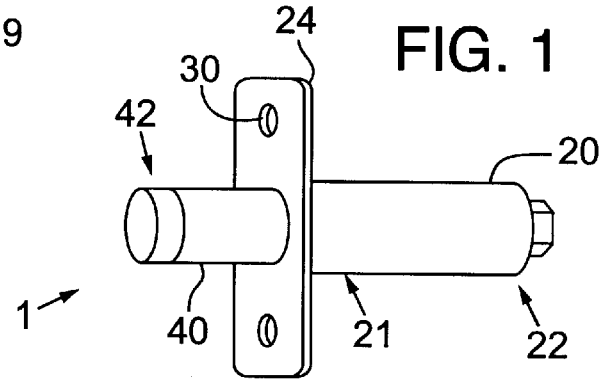
FIGS. 1, 2 and 3 are perspective, exploded and cross-sectional views, respectively, of a door opening assist device in accordance with an embodiment of the present invention.
Figure 2:
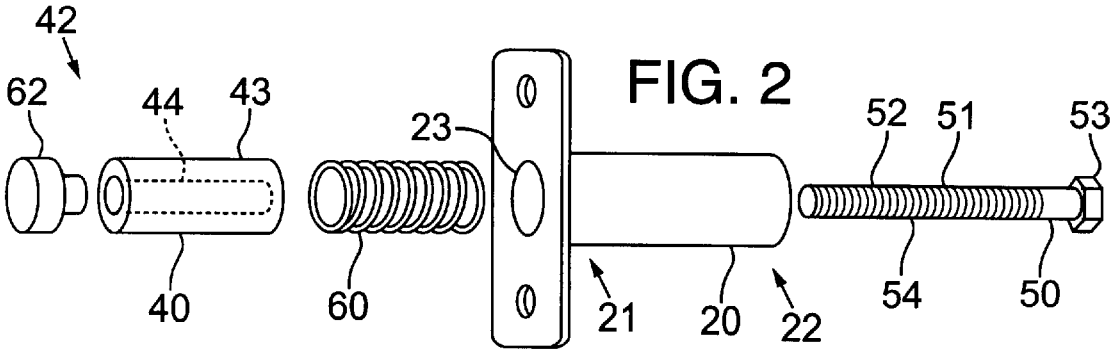
Figure 3:
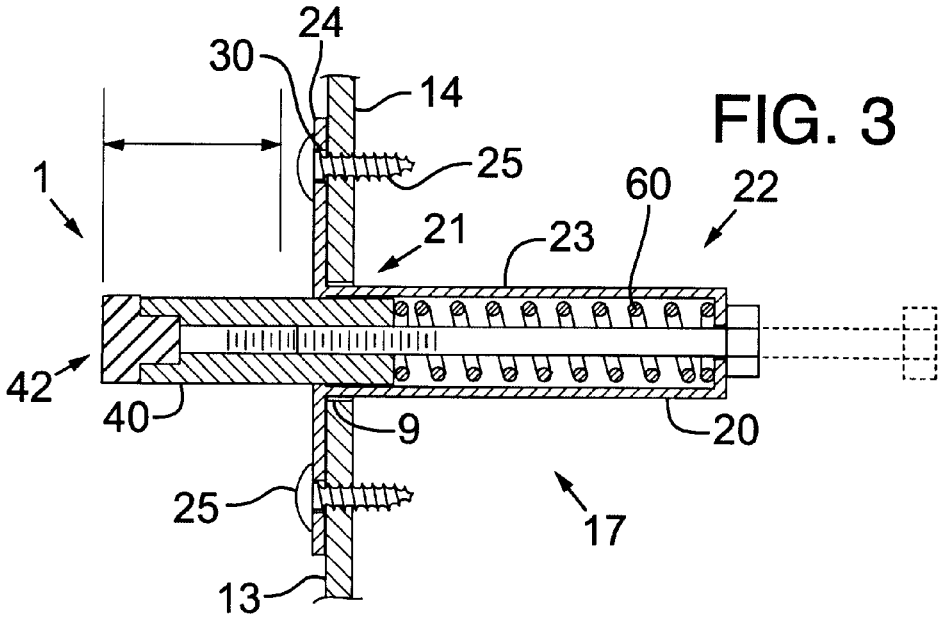

FIGS. 1, 2 and 3 are perspective, exploded and cross-sectional views, respectively, of a door opening assist device 1 in accordance with an embodiment of the present invention. The door opening assist device 1 comprises a cylindrical housing 20, a piston 40, a retention bolt 50, and a helical spring 60.

The cylindrical housing 20 comprises a first housing end 21 and a second housing end 22. The housing 20 comprises an axial housing through bore 23 comprising a first internal diameter substantially the length of the housing 20 and an second diameter, smaller than the first diameter, defining an inward-facing bore flange 8 at the second housing end 22.

The piston 40 comprises an elongated cylindrical body 41 having a first end 42 and a second end 43, and an outer diameter adapted to be slidingly received in the housing through bore 23 at the first end 21. The piston 40 further comprises an axial piston bore 44 that extends a predetermined distance into the piston second end 43. The axial piston bore 44 is threaded to accept the threaded retention bolt 50.

The helical spring 60 is formed from stiff wire appropriate for the particular purpose. The length of the spring 60 is predetermined for a particular purpose. In the embodiment of FIG. 3, the spring 60 has a length substantially the same as that of the housing bore 23. The diameter of the spring 60 is approximately the same size as the inner diameter of the housing bore 23 at the first end 21, and is adapted to be freely slidingly received by the housing bore 23 at the first end 21, and retained from passing through the second end 22 by the bore flange 8. The internal diameter of the spring 60 is adapted to freely slidingly receive the retention bolt 50.

The retention bolt 50 comprises a shaft 51 having a threaded end 52 and a head 53 opposite the threaded end 52. The shaft 51 has an outer diameter adapted to pass through the housing bore 23 at the second end 22. The head 53 is adapted to not pass through the housing bore 23 at the second end 22. The length of the threaded end 52 is predetermined for a particular purpose. In an embodiment wherein the threaded end 52 extends to the head 53, wherein the entire length of the shaft 51 is threaded, the shaft 51 may be cut to a desired length by the user.

The door opening assist device 1 is assembled by inserting the spring 60 into the housing bore 23 at the first end 21 in abutment with the bore flange 8. The retention bolt 50 is inserted such that the threaded end 52 is advanced through the housing bore 23 at the second end 22 and through the inner diameter of the spring 60. The second end 43 of the piston 40 is inserted into the housing first end 21 and threadably coupled to the retention bolt 50. The piston 40 is retained within the housing 20 by the cooperative engagement between the spring 60 urging the piston 40 out of the first end 21 and the head 53 of the bolt 50 in abutment with the bore flange 8 of the second end 22.

The piston 40 extends out of the first end 21 of the housing 20 a predetermined distance which is adjustable to suit the intended application. The adjustment feature is provided by, among other things, the extent of the threaded engagement between the bolt 50 and the piston 40 from the point wherein the spring 60 begins to be compressed by the piston 40. Increasing the threaded engagement between the piston 40 and the bolt 50 further compresses the spring 60 and decreases the distance that the piston 40 extends from the first end 21 of the housing 20. Decreasing the distance that the piston 40 extends from the first end 21 of the housing 20, limits the full extension of the spring 60, and decreases the contact time between the piston 40 and the door, and thus, reduces the potential spring energy imparted on the door. Decreasing the extension of the piston 40, and thus the excursion of the piston 40 from a retracted position to an extended position, decreases the distance that the door is opened. The adjustment feature provides the ability to change the opening characteristics of the door opening assist device 1 to accommodate, among other things, the weight of the door and the desired door opening distance.

The length of the threaded bore 44 of the piston 40 determines, in part, the length of the piston 40 extending out of the housing 20 and therefore the amount of excursion from a retracted position to an extended position. A longer threaded bore 44 provides a greater degree of adjustment by providing a longer engagement between the threaded end 52 and the piston 40.

Figure 4:
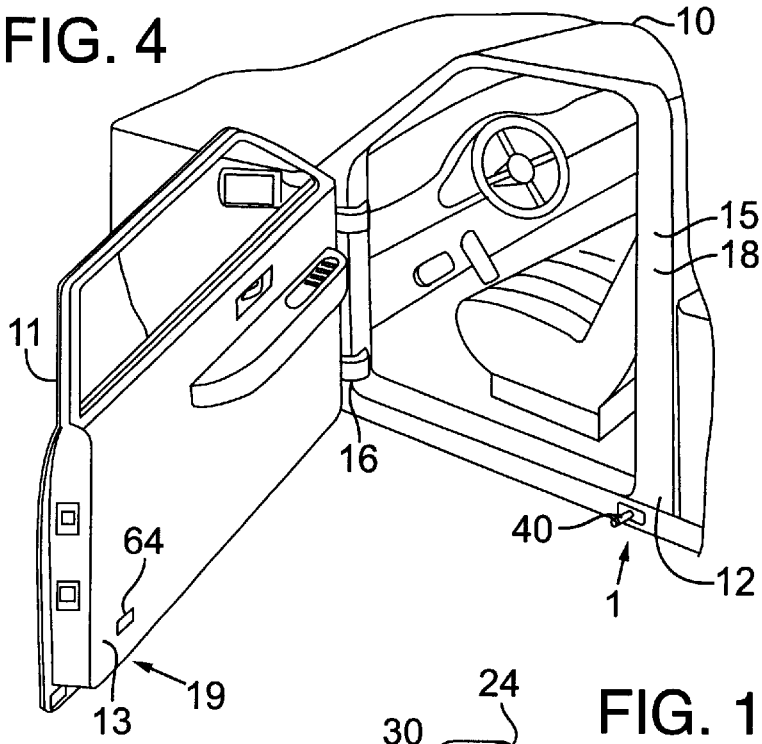
FIG. 4 is a perspective view of a door opening assist device in an automobile application, in accordance with an embodiment of the invention.

FIG. 4 is a perspective view of a door opening assist device 1 in an automobile application, in accordance with an embodiment of the invention. In a typical application, the door opening assist device 1 is installed in a door frame 15 of an automobile 10 to push the door 11 open a predetermined distance. Upon closing the door, the door 11 abuts and retracts the piston 40 into the housing 20 compressing the spring 60. Upon unlatching the door 11, the piston 40 extends under spring bias in such a direction and with sufficient force to push the door 11 to an open position a predetermined distance. The piston 40 will impart enough kinetic energy that the inertia of the door 11 will carry the door 11 open to a predetermined distance after contact between the piston 40 and the door 11 is broken. The adjustment feature is used to tailor the opening characteristics of the door opening assist device 1 to control the opening of the door 11.

To effect the adjustment of the extent of the threaded engagement between the bolt 50 and the piston 40, the piston 40 can be rotated with respect to the bolt 50 while the door opening assist device 1 remains mounted in the structure 13. Frictional engagement between the bolt head 53 and the second end 22 is adapted to be sufficient to restrain the bolt 50 from rotating as the piston 40 is advanced onto the threads 54 of the bolt 50. Alternatively, the door opening assist device 1 can be removed from the structure 13 and adjusted by turning the bolt head 53 while restraining the piston 40 from rotating.

In an embodiment in accordance with the present invention, the door opener assist device 1 further comprises a strike plate 64. The strike plate 64 is provided on the portion of the door 11 that is engaged by the piston 40, the door contact area 19. The strike plate 64 protects the surface upon which it is coupled by structurally reinforcing the surface as well as protecting the surface from abrasion by the first end 42 of the piston 40. The strike plate 64 may be coupled to the door contact area 19 with, but not limited to, fasteners and adhesive.

In another embodiment, the piston 40 further comprises a tip 62 of resilient material, such as but not limited to, plastic and rubber, on the piston first end 42. The tip 62 provides protection for the door contact area 19 when in contact with the piston 40. The attachment of the tip 62 is made with well known methods including, but not limited to, adhesive end fasteners. In one embodiment, the threaded bore 44 extends through the piston 40 providing a threaded bore 44 onto which a threaded tip 62 is attached. The resilient tip 62 is useful for, but not limited to, reducing the need for a strike plate 64, to protected the finish of the contact area 19, such as a door panel, and to reduce any contact noise between the contact area 19 and the piston 40.

The door opening assist device 1 is mounted to a structure 13 either on the door 11 or on the door frame 15 wherein the piston 40 can push open the door 11. A satisfactory mounting location is in the doorjamb 12 of the automobile chassis 18 in a position distal from the door hinge 16. The door opening assist device 1 is mounted such that the piston 40 extends in an outward direction and the housing 20 extends into the automobile frame 15.

There are a number of methods to mount the door opening assist device 1 to a frame 15 or structure 13 of the car 10. In most applications, the mounting structure 13 will comprise sheet metal having a rigid, but relatively thin thickness.

In another embodiment in accordance with the invention, the first end 21 of the housing 20 comprises a mounting flange 24 that is perpendicular to the axis of the housing 20. The mounting flange 24 extends collinearly in opposite directions from the first end 21. The flange 24 comprises at least one mounting aperture 30. The mounting apertures 30 are adapted to accept mounting fasteners 25. Examples of acceptable fasteners 25 include, are not limited to, rivets, sheet metal screws, self-tapping screws, bolts and nuts. The mounting flange 24 may be recessed flush to the structure 13 or mounted against and raised from the surface of the structure 13. This mounting method is referred to as front fastening.

Figure 5:
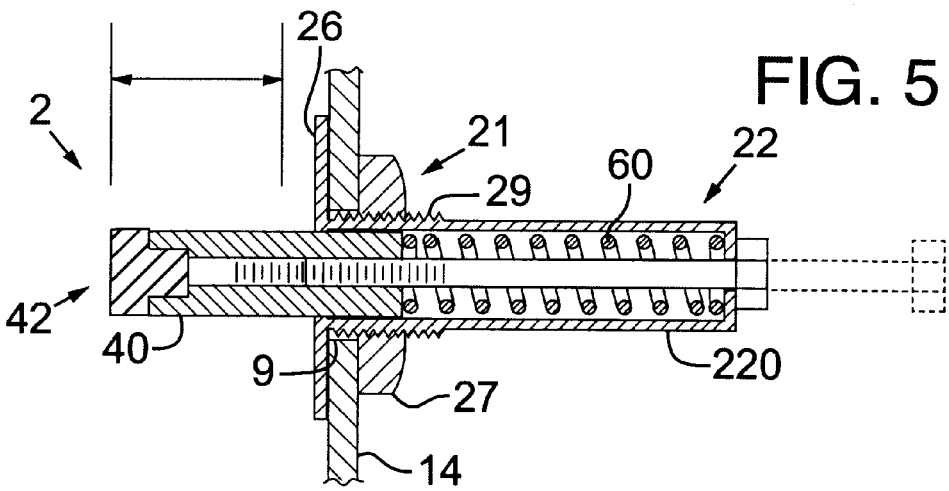
FIG. 5 is a cross-sectional view of a door opening assist device in accordance with another embodiment of the invention.

FIG. 5 is a cross-sectional view of a door opening assist device 2 in accordance with another embodiment of the invention. The first end 21 comprises a circular flange 26 extending from the first end 21 of the housing 220 and a mounting nut 27. The first end 21 further comprises threads 29 extending at least a portion of the length of the housing 220 proximate the flange 26 and adapted for threaded engagement with the mounting nut 27. In application, the second end 22 of the door opening assist device 2 is passed through an aperture 9 in the structure 13 and the mounting nut 27 is advanced over the housing second end 22 and threadably engaged and advanced onto the threads 29 to engage the structure 13 between the mounting flange 26 and the mounting nut 27. This mounting is referred to as back fastening.

Figure 6:
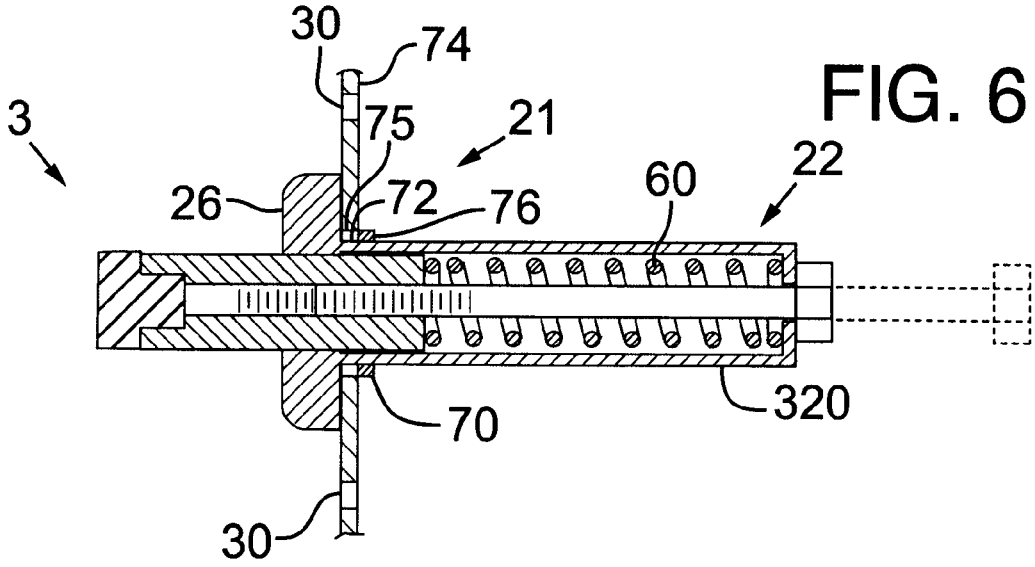
FIG. 6 is a cross-sectional view of a door opening assist device in accordance with another embodiment of the invention.

FIG. 6 is a cross-sectional view of a door opening assist device 3 in another embodiment in accordance with the invention. The door opening assist device 3 further comprises a circular flange 26 extending from the first end 21 of the housing 320 and a mounting plate 74 comprising an aperture 75. The first end 21 further comprises a capture ring 70 adapted to slidably engage the aperture 75 of the mounting plate 74 to couple the mounting plate 74 to the housing 320. The capture ring 70 comprises an enlargement of the diameter of the housing 320 spaced a predetermined distance from the flange 26 corresponding to the thickness of the mounting plate 74 defining a seat 72. The capture ring 70 provides a rearward facing sloping surface 76 having a diameter proximate the flange 26 that is greater than the diameter of the aperture 75 of the mounting plate 74 to a diameter smaller than the aperture 75 of the mounting plate 74 distal from the flange 26.

In application, the aperture 75 of the mounting plate 74 is passed over the second end 22 of the door opening assist device 3. The mounting plate 74 is forcefully advanced over the capture ring 70 to snap into the seat 72 between the capture ring 70 and the flange 26. The mounting plate 74 further comprises apertures 30 adapted to accept appropriate fasteners to couple the housing 320 to a structure 13, such as, but not limited to, a doorjamb.

Figure 7:
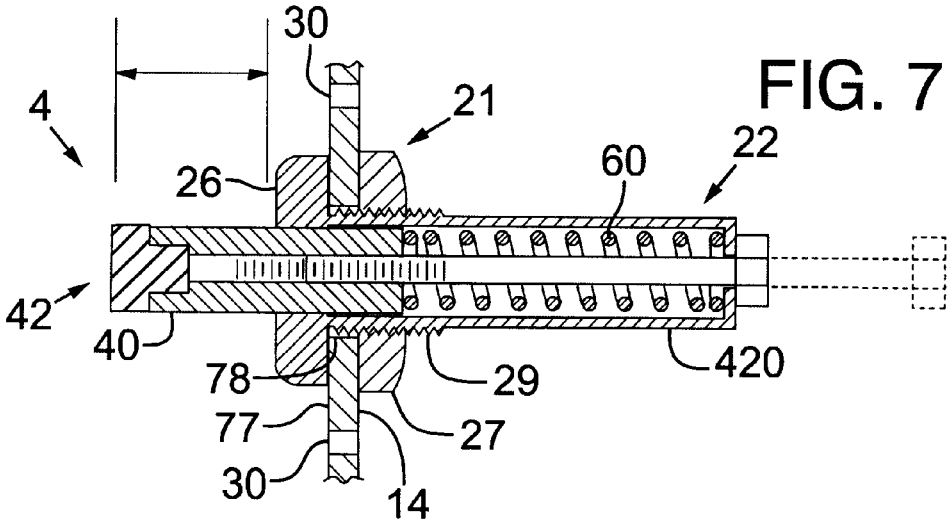
FIG. 7 is a cross-sectional view of a door opening assist device in accordance with another embodiment of the invention.

FIG. 7 is a cross-sectional view of a door opening assist device 4 in another embodiment in accordance with the invention. The door opening assist device 4 further comprises a circular flange 26 extending from the first end 21 of the housing 420, a mounting plate 77 having an aperture 78, and a mounting nut 27. The first end 21 further comprises threads 29 extending at least a portion of the length of the housing 420 proximate the flange 26 and adapted for threaded engagement with the mounting nut 27. In application, the aperture 78 of the mounting plate 77 is passed over the second end 22 of the door opening assist device 4 and advanced over the threads 29 to the flange 26 followed by the mounting nut 27 advanced onto the threads 29 to engage the mounting plate 77 between the flange 26 and the nut 27. The mounting plate 77 further comprises apertures 30 through which appropriate fasteners are used to couple the housing 420 to a structure 13, such as, but not limited to, a doorjamb.

Figure 8:
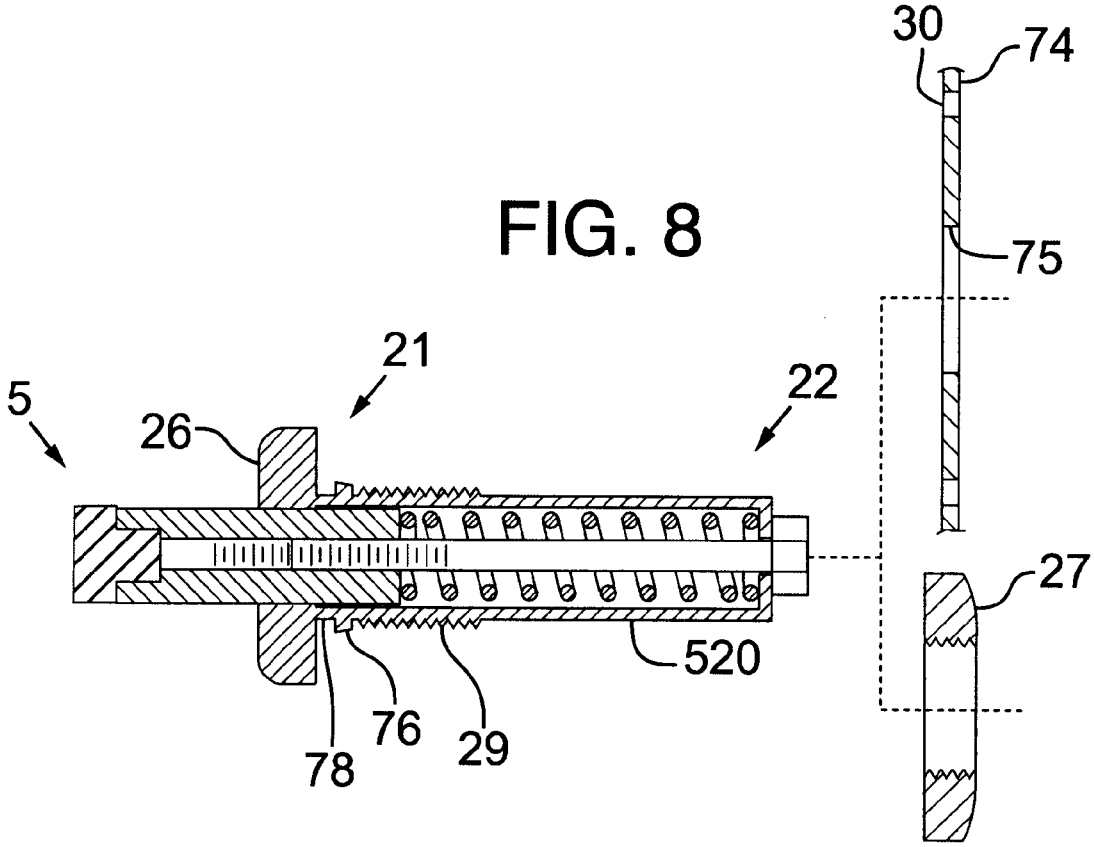
FIG. 8 is a cross-sectional view of a door opening assist device in accordance with another embodiment of the invention.

FIG. 8 is a cross-sectional view of a door opening assist device 5 in another embodiment in accordance with the invention. The door opening assist device 5 further comprises a circular flange 26 extending from the first end 21 of the housing 520, a mounting plate 74 having an aperture 75, and a mounting nut 27. The first end 21 further comprises a capture ring 70 adapted to slidably engage the aperture 75 of the mounting plate 74 to couple the mounting plate 74 to the housing 520. The capture ring 70 comprises an enlargement of the diameter of the housing 520 spaced a predetermined distance from the flange 26 corresponding to the thickness of the mounting plate 74. The capture ring 70 provides a rearward facing sloping surface 76 having a diameter proximate the flange 26 that is greater than the diameter of the aperture 75 of the mounting plate 74 to a diameter smaller than the aperture 75 of the mounting plate 74 distal from the flange 26. The first end 21 further comprises threads 29 extending at least a portion of the length of the housing 520 proximate the capture ring 70 and adapted for threaded engagement with the mounting nut 27.

In application, the user has the option of discarding the mounting plate 74 and mounting the door opening assist device 5 by passing the second end 22 of the housing 520 through an aperture 9 in the structure 13 and advancing the mounting nut 27 onto the threads 29 to engage the structure 13 between the flange 26 and the nut 27.

The user also has the option of discarding the mounting nut 27 and, from the second end 21 of the housing 520, forcefully advancing the aperture 75 of the mounting plate 74 over the capture ring 70 to snap the mounting plate 74 into the seat 72 between the capture ring 70 and the flange 26. The mounting plate 74 further comprises apertures 30 adapted to accept appropriate fasteners to couple the housing 520 to the structure 13, such as, but not limited to, a doorjamb.

As previously discussed, advancing the piston 40 onto the bolt shaft 51 subsequently reduces the excursion of the piston 40, and therefore the door 11 will open less as the piston 40 is advanced upon the shaft 51. A longer excursion would be beneficial in circumstances wherein the door 11 is relatively heavy and needs the added push of the piston 40 to open the door 11 the desired amount. A longer excursion is also beneficial to the physically challenged individual to aid in opening the door 11 wide without manual assistance. A shorter excursion would be useful for relatively light doors 11 to limit the opening distance. A shorter excursion would also be useful where it would be desired to limit the door travel to a few inches to prevent collision with nearby structures, such as in the case of tight parking lots and the like.

The door opening assist device can be made from a variety of materials suitable for the particular purpose. For example, but not limited thereto, the housing, including any flange, capture ring and/or threads, is machined from a single block of aluminum. In another example, but not limited thereto, the housing, including any flange and/or capture ring, is steel and the flange and/or capture ring is welded to the housing. In yet another example, but not limited thereto, the housing, including any flange, capture ring and/or threads, is molded as a single unit out of reinforced plastic. It is recognized that there are many processes and materials known in the art that can be used in the production of the door opening assist device.

It is recognized that there are other means for coupling the mounting flange to the housing besides the use of a mounting nut or a capture ring. Other means for coupling the mounting flange to the housing include, but are not limited to, a C-ring snapped into a groove proximate the circular flange engaging the mounting flange between the circular flange and the C-ring, fasteners passing through apertures in the circular flange and into the mounting flange, adhesives, welding, and the like.

It is recognized that the door opening assist device 1 has many more benefits beyond opening a door 11 having no external handle to pull open the door 11. For example, the door opening assist device 1 would be particularly useful in combination with standard manual door handles and latch releases for automobile passengers that lack the strength or would benefit from the opening assistance that the door opening assist device 1 would provide, such as the elderly or disabled.

The door opening assist device 1 would also be advantageously used wherein a remotely operated door is useful. One such application is in law enforcement wherein the rear door of a K-9 patrol car is remotely unlatched and pushed open by the door opening assist device 1 to release the K-9 officer.

It is appreciated that a door opening assist device 1 can be used in many applications. For example, for automobiles 10, the door opening assist device 1 can be used not only to assist in opening passenger doors 11, but may also be used to assist in the opening of trunk lids, hoods, and back hatches.

Figure 9:
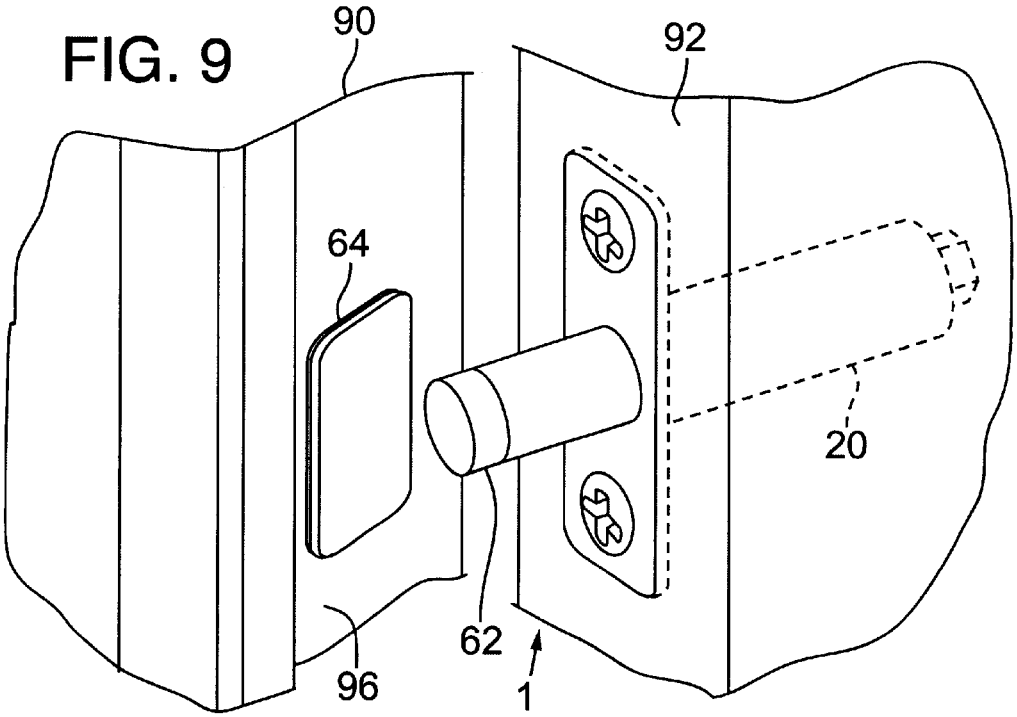
FIGS. 9 and 10 are perspective and top views, respectively, of a door opening assist device as mounted in a building doorjamb in accordance with an embodiment of the invention.
Figure 10:
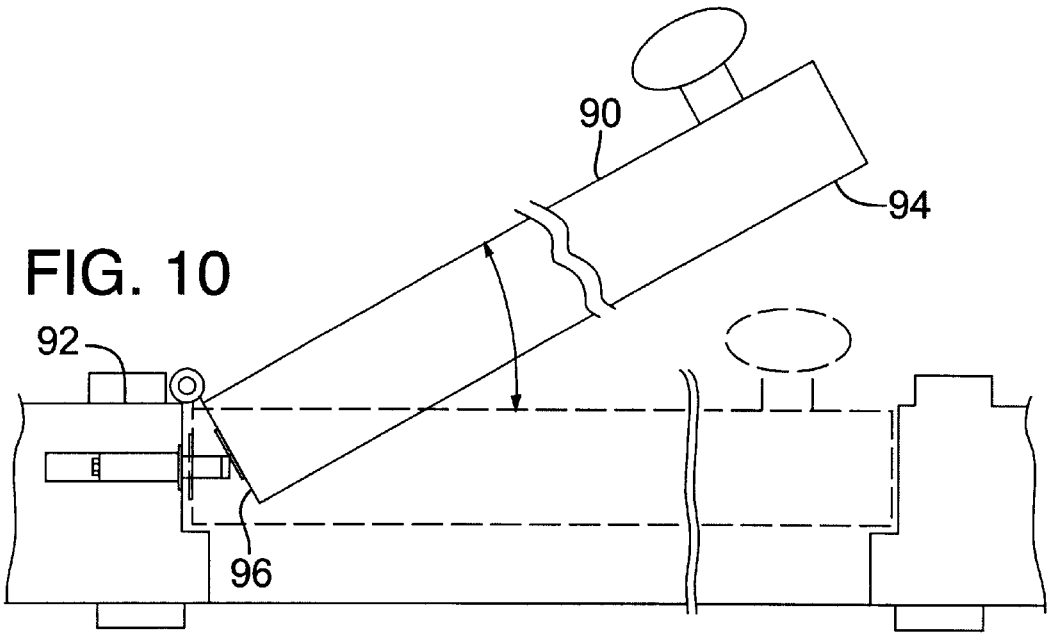

Other applications include, but are not limited to, the use of a door opening assist device 1 for building doors 90. FIGS. 9 and 10 are perspective and top views, respectively, of the application of the door opening assist device 1 as mounted in a building doorjamb in another embodiment in accordance with the invention. The door opening assist device 1 can be mounted in the doorjamb 92, either to push the free-end 94 of the door 90 such as in the case of an automobile 10, or to push the hinged edge 96 of the door 90 as shown in FIG. 10.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A door opening assist device, comprising:

a cylindrical piston having a threaded bore;

a helical spring;

a cylindrical housing having a housing bore adapted to slidingly receive the spring and the piston; and a threaded bolt having a head, the piston retaining the spring within the housing at a first end of the housing, the threaded bolt passing within the spring and engaging the threaded bore of the piston from an opposite second end of the housing, the piston retained within the housing by the cooperative engagement between the spring urging the piston out of the first end and the head of the bolt in abutment with the second end, the piston adjustably extending from the first end of the housing a predetermined distance by the cooperative engagement between the bolt and the threaded bore.

2. The door opening assist device of claim 1, wherein the diameter of the housing bore is smaller at the second end as the first end defining an inwardly-extending flange, the flange adapted to retain the spring at the second end and engage the bolt head.

3. The door opening assist device of claim 1, further comprising: a resilient tip coupled to the piston at an end external to the housing.

4. The door opening assist device of claim 1, further comprises a flange extending from the first end of the housing, the flange comprising one or more apertures adapted to accept appropriate fasteners to couple the housing to a structure.

5. The door opening assist device of claim 1, further comprising:

a circular flange extending from the first end of the housing; and a mounting nut, the first end further comprising threads extending at least a portion of the length of the housing proximate the flange and adapted for threaded engagement with the mounting nut, wherein the second end of the door opening assist device is adapted to pass through an aperture in a structure, the mounting nut engaging the threads to engage the structure between the flange and the nut.

6. The door opening assist device of claim 1, further comprising:

a circular flange extending from the first end of the housing;

a mounting plate having a housing aperture adapted to receive the housing and one or more apertures adapted to accept appropriate fasteners to couple the housing to a structure; and means for coupling the mounting plate to the housing in abutment with the circular flange.

7. The door opening assist device of claim 1, further comprising:

a circular flange extending from the first end of the housing; and a mounting plate having a housing aperture adapted to receive the housing, the first end further comprising a capture ring adapted to slidably engage the aperture of the mounting plate to couple the mounting plate to the housing, the capture ring comprising an enlargement of the diameter of the housing spaced a predetermined distance from the flange corresponding to the thickness of the mounting plate defining a seat, the capture ring having a rearward facing sloping surface having a diameter proximate the flange that is greater than the diameter of the aperture of the mounting plate to a diameter smaller than the aperture of the mounting plate distal from the flange, wherein the mounting plate is adapted to be forcefully advanced over the capture ring to snap into the seat between the capture ring and the flange, the mounting plate further comprises one or more apertures adapted to accept appropriate fasteners to couple the housing to a structure.

8. The door opening assist device of claim 1, further comprising:

a circular flange extending from the first end of the housing;

a mounting plate having a housing aperture adapted to receive the housing; and a mounting nut, the first end further comprising threads extending at least a portion of the length of the housing proximate the flange and adapted for threaded engagement with the mounting nut, the mounting flange engaged between the flange and the mounting nut, the mounting plate further comprising one or more apertures adapted to accept appropriate fasteners to couple the housing to a structure.

9. The door opening assist device of claim 1, further comprising:

a circular flange extending from the first end of the housing;

a mounting plate having a housing aperture adapted to receive the housing and one or more apertures adapted to accept appropriate fasteners to couple the housing to a structure; and a mounting nut, the first end further comprising a capture ring adapted to slidably engage the aperture of the mounting plate to couple the mounting plate to the housing, the capture ring comprising an enlargement of the diameter of the housing spaced a predetermined distance from the flange corresponding to the thickness of the mounting plate defining a seat, the capture ring having a rearward facing sloping surface having a diameter proximate the flange that is greater than the diameter of the aperture of the mounting plate to a diameter smaller than the aperture of the mounting plate distal from the flange, wherein the mounting plate is adapted to be forcefully advanced over the capture ring to snap into the seat between the capture ring and the flange, the mounting plate further comprises one or more apertures adapted to accept appropriate fasteners to couple the housing to a structure, the first end further comprising threads extending at least a portion of the length of the housing proximate the capture ring and adapted for threaded engagement with the mounting nut, wherein the second end of the door opening assist device is adapted to pass through an aperture in a structure, the mounting nut engaging the threads to engage the structure between the flange and the nut.

10. A door opening assist device, comprising:

a cylindrical piston having a threaded bore;

a helical spring;

a cylindrical housing having a housing bore adapted to slidingly receive the spring and the piston, the diameter of the housing bore being smaller at a second end as a first end defining an inwardly-extending flange, the flange adapted to retain the spring at the second end; and a threaded bolt, the piston retaining the spring within the housing at the first end of the housing, the threaded bolt passing within the spring and engaging the threaded bore of the piston from the opposite second end of the housing, the piston retained within the housing by the cooperative engagement between the spring urging the piston out of the first end and the head of the bolt in abutment with the flange of the second end, the piston adjustably extending from the first end of the housing a predetermined distance by the cooperative engagement between the bolt and the threaded bore.

11. The door opening assist device of claim 10, further comprising: a resilient tip coupled to the piston at an end external to the housing.

12. The door opening assist device of claim 10, further comprises a flange extending from the first end of the housing, the flange comprising one or more apertures adapted to accept appropriate fasteners to couple the housing to a structure.

13. The door opening assist device of claim 10, further comprising:

a circular flange extending from the first end of the housing; and a mounting nut, the first end further comprising threads extending at least a portion of the length of the housing proximate the flange and adapted for threaded engagement with the mounting nut, wherein the second end of the door opening assist device is adapted to pass through an aperture in a structure, the mounting nut engaging the threads to engage the structure between the flange and the nut.

14. The door opening assist device of claim 10, further comprising:

a circular flange extending from the first end of the housing;

a mounting plate having a housing aperture adapted to receive the housing and one or more apertures adapted to accept appropriate fasteners to couple the housing to a structure; and means for coupling the mounting plate to the housing in abutment with the circular flange.

15. The door opening assist device of claim 10, further comprising:

a circular flange extending from the first end of the housing; and a mounting plate having a housing aperture adapted to receive the housing, the first end further comprising a capture ring adapted to slidably engage the aperture of the mounting plate to couple the mounting plate to the housing, the capture ring comprising an enlargement of the diameter of the housing spaced a predetermined distance from the flange corresponding to the thickness of the mounting plate defining a seat, the capture ring having a rearward facing sloping surface having a diameter proximate the flange that is greater than the diameter of the aperture of the mounting plate to a diameter smaller than the aperture of the mounting plate distal from the flange, wherein the mounting plate is adapted to be forcefully advanced over the capture ring to snap into the seat between the capture ring and the flange, the mounting plate further comprises one or more apertures adapted to accept appropriate fasteners to couple the housing to a structure.

16. The door opening assist device of claim 15, wherein the housing, circular flange, capture ring and threads are integrally formed from one material component.

17. The door opening assist device of claim 16, wherein the one material component is an aluminum billet.

18. The door opening assist device of claim 10, further comprising:

a circular flange extending from the first end of the housing;

a mounting plate having a housing aperture adapted to receive the housing; and a mounting nut, the first end further comprising threads extending at least a portion of the length of the housing proximate the flange and adapted for threaded engagement with the mounting nut, the mounting flange engaged between the flange and the mounting nut, the mounting plate further comprising one or more apertures adapted to accept appropriate fasteners to couple the housing to a structure.

19. The door opening assist device of claim 10, further comprising:

a circular flange extending from the first end of the housing;

a mounting plate having a housing aperture adapted to receive the housing and one or more apertures adapted to accept appropriate fasteners to couple the housing to a structure; and a mounting nut, the first end further comprising a capture ring adapted to slidably engage the aperture of the mounting plate to couple the mounting plate to the housing, the capture ring comprising an enlargement of the diameter of the housing spaced a predetermined distance from the flange corresponding to the thickness of the mounting plate defining a seat, the capture ring having a rearward facing sloping surface having a diameter proximate the flange that is greater than the diameter of the aperture of the mounting plate to a diameter smaller than the aperture of the mounting plate distal from the flange, wherein the mounting plate is adapted to be forcefully advanced over the capture ring to snap into the seat between the capture ring and the flange, the mounting plate further comprises one or more apertures adapted to accept appropriate fasteners to couple the housing to a structure, the first end further comprising threads extending at least a portion of the length of the housing proximate the capture ring and adapted for threaded engagement with the mounting nut, wherein the second end of the door opening assist device is adapted to pass through an aperture in a structure, the mounting nut engaging the threads to engage the structure between the flange and the nut.

* * * * *

UNITED STATES PATENT AND TRADEMARK OFFICE

CERTIFICATE OF CORRECTION

PATENT NO. : 6,711,856 B1 
DATED : March 30, 2004
INVENTOR(S) : Lawrence Andrew Hoffman It is certified that error appears in the above-identified patent and that said Letters Patent is hereby corrected as shown below:

Title page,
Item [75], Inventors, change "Drew Hoffman" to -- Lawrence Andrew Hoffmann --.

Signed and Sealed this

Twenty-eighth Day of September, 2004

JON W. DUDAS
*Director of the United States Patent and Trademark Office*